US005972072A

United States Patent [19]

Kinsman et al.

[11] Patent Number: 5,972,072

[45] Date of Patent: Oct. 26, 1999

[54] DESULFURIZING MIX

[75] Inventors: Brian Mark Kinsman, Welland, Canada; Leon A. Luyckx, New Castle, Pa.; James H. Young, Jr., Poland, Ohio; Robert V. Branion, Jr., Valparaiso, Ind.

[73] Assignees: Reactive Metals & Alloys Corporation, West Pittsburg; USX Corporation, Pittsburgh, both of Pa.

[21] Appl. No.: 09/084,657

[22] Filed: May 26, 1998

Related U.S. Application Data

[62] Division of application No. 08/826,880, Apr. 7, 1997, Pat. No. 5,873,924.

[51] Int. Cl.[6] ..... C21C 7/064

[52] U.S. Cl. ..... 75/315

[58] Field of Search ..... 75/315

[56] References Cited

U.S. PATENT DOCUMENTS

| | | | |
|---|---|---|---|
| 3,876,421 | 4/1975 | Takemura | 75/58 |
| 4,014,684 | 3/1977 | Jones et al. | 75/51 |
| 4,142,887 | 3/1979 | Luyckx | 75/58 |
| 4,266,969 | 5/1981 | Koros | 75/58 |
| 4,274,869 | 6/1981 | Kristianson et al. | 75/53 |
| 4,374,664 | 2/1983 | Mitsuo | 75/58 |
| 4,708,737 | 11/1987 | Skach, Jr. et al. | 75/58 |
| 4,764,211 | 8/1988 | Meichsner et al. | 75/58 |
| 5,021,086 | 6/1991 | Luyckx | 75/315 |
| 5,284,504 | 2/1994 | Barker et al. | 75/312 |
| 5,366,539 | 11/1994 | Abele et al. | 75/532 |
| 5,397,379 | 3/1995 | Barker et al. | 75/319 |

FOREIGN PATENT DOCUMENTS

| | | |
|---|---|---|
| 0724 018 | 7/1996 | European Pat. Off. . |
| 55-085611 A | 6/1980 | Japan . |

OTHER PUBLICATIONS

Goran Carlsson et al., "Lime injection desulfurization of hot metal–optimizing parameters of alumium addition," Scandinavian Journal of Metals, Sep. 1996, pp. 50–56.

H. T. Kossler et al., "Development of Lime Based Hot Metal Desulfurization at J&L", McMaster Sym., No. 11 (1983).

Tosiharu Mitsuo et al., "Improvement of Desulfurization by Addition of Alumina to Hot Metal in the Lime Injection Process," *Transactions of the Japan Institute of Metals*, vol. 23, No. 12 (1982), pp. 768–779.

*Primary Examiner*—Melvyn Andrews

*Attorney, Agent, or Firm*—Buchanan Ingersoll, P.C.

[57] ABSTRACT

A desulfurization composition contains from about 3% to about 20% particulate metallic aluminum, about 5% to about 30% particulate alumina, about 0.5% to about 12% particulate hydrocarbon material or other gas generating composition and the balance lime plus impurities. Preferably aluminum dross is the source of aluminum and alumina. The desulfurization composition is injected into molten iron from a blast furnace preferably in an amount of 4 to 20 pounds desulfurizer per ton of hot metal. The desulfurizing composition can be injected as a blend or co-injected into the hot metal through a lance using a carrier gas or dumped into the hot metal as it is being poured into the ladle. At least for torpedo ladles, the desulfurization composition can be placed in the ladle before the hot metal is poured into it.

7 Claims, 2 Drawing Sheets

DESULFURIZING MIX

RELATED APPLICATIONS

This application is a division of U.S. patent application Ser. No. 08/826,880, filed Apr. 7, 1997, now U.S. Pat. No. 5,873,924.

BACKGROUND OF THE INVENTION

1. Field of the Invention

The invention relates to a desulfurizing composition and method for desulfurizing molten pig iron, cast iron and malleable iron.

2. Description of the Prior Art

Steelmakers generally desire to have a minimum amount of sulfur in the steel they produce, as well as in the molten iron from which the steel is made. Presently, molten iron from the blast furnace is desulfurized by the injection of a suitable reagent with a carrier gas, usually nitrogen. One widely used desulfurizing reagent is a mixture of particulate lime and particulate magnesium. Although this reagent performs well as a desulfurizer, steelmakers have been seeking alternative reagents. This search has been prompted by the facts that magnesium lime reagents are flammable and that metallic magnesium, which may be 90% of this mix, is quite costly.

Several people have proposed to substitute metallic aluminum or metallic aluminum and alumina for the magnesium. Mitsuo et al. in U.S. Pat. No. 4,374,664 assigned to Nippon Steel disclose a process for desulfurizing molten pig iron in which powdered aluminum and lime or powdered aluminum, alumina and lime are injected into molten pig iron. Although this composition provides adequate desulfurization, metallic aluminum is also quite costly.

In U.S. Pat. No. 5,021,086 there is disclosed an iron desulfurization additive containing a granular mixture of metallic magnesium, calcium oxide and a small amount of hydrocarbon containing material which provide a volatile gas producing component to the mixture. The patent teaches that the hydrocarbon constituent improves the desulfurization of the magnesium-lime mixture by increasing the surface area of the magnesium-lime agglomerations. At high operating temperatures found in molten iron, the hydrocarbon constituent forms a gas which breaks down the magnesium-lime agglomerations. This desulfurizer is relatively expensive.

In the summer of 1995 Reactive Metals & Alloys Corporation, one of the assignees of the present application, tested a reagent at an integrated steel plant in the United States which contained 65% lime, 27% aluminum, 6% fluorspar and 2% hydrocarbons. This reagent was injected at the rate of from 1.5 to 6 pounds reagent per ton of molten metal and resulted in removal of from about 0.003% to about 0.02% sulfur. Those observing the trial were disappointed because the low sulfur removal and the cost of pure aluminum resulted in an unacceptable cost per point of sulfur removed. Fluorspar could have contributed to the low sulfur removal.

Consequently, there is a need for a low cost desulfurization composition that can be used in molten iron from a blast furnace which will remove at least 40% and preferably near 100% of the sulfur present in the molten iron.

The following reaction:

$$CaO+S \leftrightarrows CaS+O$$

is generally recognized as underlying all the lime-based desulfurizing processes. Provided an excellent "home" is continuously provided in situ for the liberated oxygen atom, the reaction can be completed towards residual sulfurs in molten metals below 1 ppm S if required.

There are many elements which will react with the free oxygen if those elements are present in the hot metal. At typical 2400° F. temperatures of hot metal to be desulfurized, free energies of formation of the oxide compounds show the following preference for the effectiveness of such elements for the liberated oxygen atom expressed as $\Delta G°f$ in BTU's per pound-mole of $O_2$ gas.

440 Scandium, Sc metal
410–420 Heavy Lanthanides Yttrium: Y, Dy, Ho, Er, Tm, Lu
405 Calcium, Ca metal alloys and compounds
390 Strontium, Sr metal
380–395 Light Lanthanides: La, Ce, Nd, Pr . . . Gd
375 Beryllium, Be metal
355 Barium, Ba metal
350 Magnesium, Mg metal and alloys
340 Zirconium, Zr metal and alloys
335 Aluminum, Al metal and alloys
280–325 Titanium, Ti metal and alloys
255 Silicon, Si metal and alloys Almost all of these elements have been rejected as the deoxidizing additive for hot metal desulfurization because of their cost. Scandium for example costs about $10,000.00 per pound. Beryllium and barium are toxic as well as expensive. Only calcium and magnesium have been used extensively. Calcium metal and calcium silicon are too expensive. Calcium carbide, $CaC_2$, is extensively used worldwide for molten pig iron desulfurization. However, because of its price and lack of complete molecular splitting at 2400° F., calcium carbide will lose its competitiveness with our composition. There are also safety concerns about using calcium carbide. Pure magnesium and magnesium alloys have been used because they are less expensive than the alternatives, but they are still costly. Silicon metal and alloys are economical, but tend to form $SiO_2$ which forms solid envelopes of dicalcium silicate, 2 $CaO\text{-}SiO_2$, blocking the process.

From a strictly thermodynamic equilibrium consideration viewpoint, the above list indicates that aluminum which is close enough to magnesium in free energy of formation should perform almost as well as magnesium. Indeed, literature going back several decades, for and U.S. Pat. No. 4,374,664 to Nippon Steel clearly confirm that aluminum and aluminum alloys have been given extensive and serious experimentation as critical additive to lime for hot metal desulfurization and have performed to some extent.

If an aluminum containing agent is used, it is of paramount importance that the highest possible concentration of aluminum be present at the same location as where solid lime encounters sulfur atoms dissolved in the molten metal being treated. Thus, pretreatments by aluminum have to be inferior, kinetically and economically because aluminum tends to be strongly depleted locally, stopping the reaction. Also, this indicates that it is redundant and uneconomical to provide excess aluminum content in the hot metal before, during or even after lime injection. That observation is contrary to the teaching of U.S. Pat. No. 4,374,664 which seeks to have aluminum present.

In practice, this implies that the blend quality should ascertain an intimate closeness of the lime particles with the aluminum metal bearing particles so as to guarantee this same location requirement. However, prior to this invention, these lime-aluminum blends, even with all the other additives considered so far such as alumina, have not to our knowledge, been able to compete effectively with lime-magnesium blends or with calcium carbide and/or calcium carbide/magnesium combinations with or without lime.

SUMMARY OF THE INVENTION

We provided a desulfurization composition containing from about 3% to about 20% particulate metallic aluminum, about 5% to about 30% particulate alumina, about 0.5% to about 12% particulate hydrocarbon material or other gas generating composition and the balance lime plus impurities. We prefer to use aluminum dross as the source of aluminum and alumina, but other sources of aluminum and alumina could be used. The desulfurization composition is injected into molten iron from a blast furnace preferably in an amount of 4 to 20 pounds desulfurizer per ton of hot metal. The desulfurizing composition can be injected into the hot metal through a lance using a carrier gas or dumped into the hot metal as it is being poured into the ladle. At least for torpedo ladles, the desulfurization composition can be placed in the ladle before the hot metal is poured into it.

We have found that desulfurization rates in excess of 60% can be obtained in a torpedo ladle using 10 or more pounds reagent per ton of hot metal. Six pounds or more reagent per ton of hot metal deeply injected into a transfer ladle of molten iron has provided in excess of 60% desulfurization. Indeed, at 10 to 13 pounds of reagent per net ton of hot metal in a transfer ladle we obtained in excess of 90% desulfurization.

We may add 8 to 10 pounds per ton of this desulfurizing mix to the hot metal followed by an addition of a conventional lime and magnesium reagent. The amount added is based upon the initial sulfur content of the hot metal and the desired final sulfur content.

For overall results of 90% to 99% desulfurization as demonstrated by industrial trials hereunder, it is deemed essential to supply sufficient—but not excessive—amounts of alumina, $Al_2O_3$, so as to supply a quick fluxing of the unreacted part of the lime, CaO, into 3 $CaOAl_2O_3$—12 CaO-7 $Al_2O_3$ liquid phases to absorb the newly formed CaS and diluting it immediately in situ. This prevents instant reversion from CaS back to CaO and allows the key reaction to move to completion for the amount of metallic aluminum present. In addition, the resulting torpedo ladle slag or transfer ladle slag also has to become in major part a calcium aluminate slag, preferably as close as possible to lime saturation to achieve sulfur partition ratios at or about 200–500 to 1. Additional oxides such as $SiO_2$ (up to 15%) and MgO (up to 7%) tend to improve the fluidity and lower the melting points of these calcium aluminates and are inherited from carried-over blast furnace slags.

Just as important kinetically is the intimate mixing into the desulfurizing blend of a gas bubble generating ingredient, with emphasis again on the most reduced possible size of individual bubbles at the contact with liquid hot metal and the highest possible number of these gas bubbles. It is also essential that the composition of this gas be at least neutral such as nitrogen or, preferably reducing, such as hydrocarbons, cracking instantly into reducing hydrogen gas and elemental carbon.

Our composition and method use no magnesium and no calcium carbide but rely upon the intimate mixing of aluminum metal, alumina and hydrocarbons with/or without other natural or reducing gas generating ingredients in such proportions as to provide excess CaO, the formation of a CaO-$Al_2O_3$, liquid compounds to absorb and dilute CaS and the formation in situ of the correct amount of "micro-bubbles" to increase metal-to-blend mass contact during the ascension of the injected blend to the surface of the bath. The whole process guarantees a sufficient sulfur partition ratio in the top slag to prevent secondary reversion of the removed sulfur. There is no need for residual aluminum metal at any time before, during or after the injection procedure.

Our preferred composition contains aluminum dross as the source of aluminum and alumina. Since our composition range based upon aluminum dross is significantly lower in cost than magnesium, pure aluminum and calcium carbide, our composition is relatively inexpensive per unit sulfur removed per net ton of hot metal treated. We estimate that the total reagent cost of our composition will be about 30% less than the total reagent cost of the conventional 90% magnesium, 10% lime reagent, co-injected with lime to yield 20% to 25% overall magnesium content.

In addition, our desulfurizing composition and method lead to vastly improved deslagging capability and time and reduced iron losses. Finally, our composition and method reduce sulfur reversion after blow in the subsequent BOF operations because of better slag skimming efficiency.

Other objects and benefits of this invention will become apparent from a description of the preferred embodiments and the test results shown in the FIGS.

DESCRIPTION OF THE PREFERRED EMBODIMENTS

Figure 1:
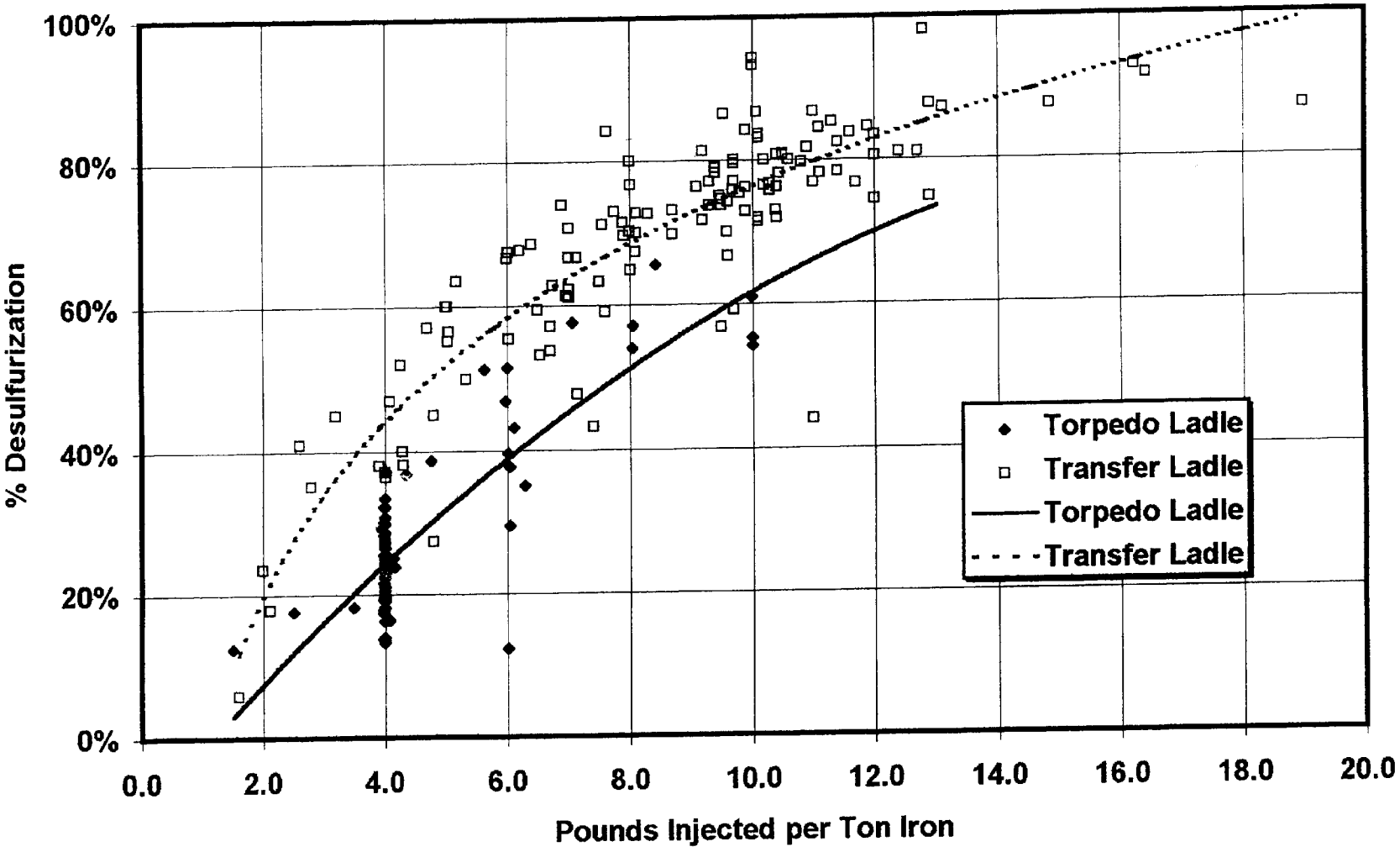
FIG. 1 is a graphical presentation of individual data points and regression lines showing the degree of desulfurization possible with the present invention reagent.

The composition of the present invention is based on lime as the primary component and contains aluminum, alumina, and a non-oxidizing gas generating additive. The aluminum and alumina are preferably in the form of aluminum dross. Preferably, the non-oxidizing gas generating additive will be a reducing gas generating additive based on a hydrocarbon component. However, soda ash could be used. The composition of the reagent is in the following concentration, the total weight being 100 percent.

| Component | Weight Percent |
|---|---|
| Aluminum Dross | about 10% to 50% |
| Hydrocarbon (or other gas generator) | about 0.5% to 12% |
| Lime | balance |

The process for using the reagent described above consists of adding the reagent to molten iron by injection with a carrier gas, typically through a lance as deeply as possible within the bath. The reagent may be added in whole as a blend or may be added separately or in combination from individual storage and injection vessels so as to approximately match the preferred blend composition above as closely as possible. Additionally, when injecting separately or in combination from separate vessels, the ratios of the components may be varied in order to vary the composition of the material exiting the lance tip throughout the course of the injection or to introduce the components in sequence.

For torpedo ladles it is possible to add the reagent while the hot metal is being poured from the blast furnace or place sufficient reagent in the torpedo ladle before pouring. Movement of the hot metal as it fills the torpedo ladle will mix the reagent into the molten bath.

The injection rate of the blend or combined injection rates of the individual components is typically 50 to 250 pounds per minute but may vary widely depending on the size and geometry of the hot metal ladle, quantity of iron in the ladle, depth of iron in the ladle, freeboard in the ladle, time permitted for the injection or any combination of these factors. Typically, for torpedo ladle injection process the injection rate is somewhat slower due to the geometry and depth of iron factors listed above and generally falls within the range of 50 to 150 pounds per minute. For transfer ladle injection processes the injection rate is generally higher, between 150 and 250 pounds per minute because of the depth of iron involved. It should be noted that because this reagent does not utilize any magnesium, reaction turbulence is practically non-existent. Consequently, injection rates can be increased over standard lime, magnesium injection rates. It is common practice to utilize as little carrier gas as possible in order to cause a uniform injection of the solids throughout the complete injection, with higher carrier gas flow rates at the beginning and end of the injection cycle in order to keep the lance tip free from obstruction.

The amount of aluminum dross required will depend from the composition of the dross. We have used aluminum dross containing about 50% Al, about 30% $Al_2O_3$ and the balance impurities. Another suitable dross contained about 20% Al, 55% $Al_2O_3$ and the balance impurities. Similarly, the amount of hydrocarbon or other gas generator will also vary according to the material used. We prefer to provide 0.5% to 5% gilsonite, a tertiary coal containing about 80% hydrocarbons. One could also use low sulfur, high volatile coal, polyethylene, polypropelene or ground rubber tires. We prefer not to use vinyls because of their chloride content.

The effectiveness of our composition and method is readily apparent from the trials we have run. These trials are described in the examples and corresponding Tables.

Tables 1 to 3 show the degree of desulfurization obtained by injection of different quantities of the blended reagent into molten iron. Table 1 presents results from a torpedo ladle process described in Example 1. Table 2 contains results from a transfer ladle process described in Example 2. Table 3 shows a comparison of process results obtained by the use of this reagent versus a normal magnesium reagent at the same transfer ladle process described in Example 3. Table 4 gives the results of the same transfer ladle process described in Example 2 except that magnesium was added to the reagent.

TABLE 1

TORPEDO LADLE TRIALS

| | Pounds Injected per Ton of Iron Treated | | | | | |
|---|---|---|---|---|---|---|
| Data | 1–3 | 3–5 | 5–7 | 7–9 | 9–11 | Grand Total |
| Number of Investigations | 2 | 51 | 9 | 4 | 2 | 68 |
| Average Starting Sulfur (%) | 0.053 | 0.045 | 0.050 | 0.055 | 0.047 | 0.047 |
| Average Pounds Injected per Ton of Iron | 2.0 | 4.0 | 6.0 | 7.9 | 10.0 | 4.6 |
| Average Pounds Sulfur Removed | 22.8 | 37.6 | 67.1 | 102.2 | 75.9 | 46.0 |
| Average % Desulfurization | 15.0% | 23.8% | 38.6% | 58.6% | 57.7% | 28.5% |

TABLE 2

TRANSFER LADLE TRIALS

| | Pounds Injected per Ton of Iron Treated | | | | | | | |
|---|---|---|---|---|---|---|---|---|
| Data | 1–4 | 4–7 | 7–10 | 10–13 | 13–16 | 16–19 | 19–22 | Grand Total |
| Number of Investigations | 8 | 28 | 49 | 40 | 2 | 2 | 1 | 130 |
| Average Starting Sulfur (%) | 0.027 | 0.035 | 0.049 | 0.067 | 0.107 | 0.113 | 0.153 | 0.053 |
| Average Pounds Injected per Ton of Iron | 2.5 | 5.4 | 8.7 | 11.0 | 14.0 | 16.3 | 19.0 | 8.6 |
| Average Pounds Sulfur Removed | 41.8 | 111.2 | 208.2 | 322.8 | 567.2 | 624.6 | 864.5 | 229.3 |
| Average % Desulfurization | 26.5% | 53.6% | 71.4% | 79.9% | 87.3% | 92.1% | 86.9% | 68.1% |

TABLE 3

TRANSFER LADLE COMPARISON

| Turndown Sulfur Aim Group | Data | Dross Blend | Mg Blend |
|---|---|---|---|
| 0.01–0.013 | Number of Investigations | 26 | 299 |
| | Average Final Hot Metal Sulfur (%) | 0.0025 | 0.023 |
| | Average Turndown Aim Sulfur (%) | 0.010 | 0.010 |
| | Average Turndown Sulfur %) | 0.0075 | 0.0096 |
| | Average Sulfur Pickup | 0.050 | 0.0073 |
| | Average % Skimmed | 2.3% | 3.1% |
| 0.016–0.019 | Number of Investigations | 73 | 1362 |
| | Average Final Hot Metal Sulfur (%) | 0.0132 | 0.0129 |
| | Average Turndown Aim Sulfur (%) | 0.018 | 0.018 |
| | Average Turndown Sulfur %) | 0.0131 | 0.0141 |
| | Average Sulfur Pickup | 0.0000 | 0.0012 |
| | Average % Skimmed | 2.7% | 2.5% |
| 0.019–0.022 | Number of Investigations | 28 | 531 |
| | Average Final Hot Metal Sulfur (%) | 0.0153 | 0.0146 |
| | Average Turndown Aim Sulfur (%) | 0.020 | 0.020 |
| | Average Turndown Sulfur %) | 0.0131 | 0.0152 |
| | Average Sulfur Pickup | −0.0022 | 0.0006 |
| | Average % Skimmed | 2.5% | 2.5% |

TABLE 4

TRANSFER LADLE TRIALS with MAGNESIUM

| | Pounds Injected per Ton of Iron Treated | | | |
|---|---|---|---|---|
| Data | 6–7 | 7–8 | 8–9 | Grand Total |
| Number of Investigations | 1 | 4 | 1 | 6 |
| Average Starting Sulfur (%) | 0.067 | 0.063 | 0.071 | 0.065 |
| Average Pounds Injected per Ton of Iron | 7.0 | 7.4 | 8.0 | 7.4 |
| Average Pounds Sulfur Removed | 204.7 | 243.9 | 248.6 | 238.2 |
| Average % Desulfurization | 50.7% | 64.3% | 52.1% | 60.0% |

EXAMPLE 1

A series of 68 investigations were conducted at a torpedo ladle hot metal desulfurization facility within a domestic integrated iron and steel plant. The blended reagent composition was as follows:

87% lime

12% Aluminum Dross (50–55% Al, 25–30% $Al_2O_3$, balance impurities)

1% Hydrocarbons (gilsonite containing 82% hydrocarbons)

The reagent was injected through a refractory lance at about 90 to 110 pounds per minute into torpedo ladles varying in size from nominal capacity of 150 tons of hot metal to 260 tons of hot metal. Samples of iron were obtained prior to the reagent being injected and analyzed for sulfur concentration using a LECO Sulfur Analyzer. Predetermined quantities of the reagent were injected followed by a second sulfur analysis in order to determine the degree of desulfurization obtained. After the injection of this reagent and the second sulfur test, the torpedo ladle was moved to another position to continue the desulfurization process using a lime and magnesium based reagent as required by the steelmaking facility.

As can be seen by the results shown on Table 1, as more reagent is added a higher degree of desulfurization is obtained. With prior art reagents even though more reagent is added, especially 7 to 8 pounds per ton of iron treated, the degree of desulfurization tends to stop. However, with this reagent the degree of desulfurization continues to increase as seen in the regression line portrayed in FIG. 1.

A method of use with this reagent whereby the practice of halting the injection, sampling and analyzing for the degree of desulfurization and then continuing with magnesium was practiced. In a number of cases the introduction of a 80% Mg and 20% CaO reagent was subsequently co-injected with this reagent after about 50 percent desulfurization was achieved. Indeed, a process whereby 50% desulfurization could be predicted from the regression line shown on FIG. 1 eliminates the need to actually stop the process for analysis.

EXAMPLE 2

A series of 130 investigations were conducted at a transfer ladle hot metal desulfurization facility within a domestic integrated iron and steel plant. The blended reagent composition was as follows:

85–86% Lime

12% Aluminum Dross (40–55% Al, 25–30% $Al_2O_3$, balance impurities)

2–3% Hydrocarbons (gilsonite containing 82% hydrocarbons)

The reagent was injected through a refractory lance at about 140 to 180 pounds per minute into a transfer ladle with a nominal capacity of about 320 tons of hot metal. Samples of iron were obtained prior to the reagent being injected and analyzed for sulfur concentration using a LECO Sulfur Analyzer. Based on the experience from Example 1 an equation was derived that produced the necessary quantity of reagent that would need to be injected in order to obtain the degree of desulfurization to meet the final sulfur specifications of the hot metal for the steelmaking process. As in Example 1, a sample of iron was obtained and analyzed prior to the injection and again after the reagent injection in order to determine the degree of desulfurization obtained. Results were such that it was not necessary to continue the desulfurization process using a lime and magnesium based reagent as in Example 1.

As can be seen by the results shown in Table 2, as more reagent is added a higher degree of desulfurization is obtained; Again with this reagent the degree of desulfurization continues to increase (as seen in the regression line portrayed on FIG. 1) even to nearly 100 percent desulfurization. This is especially evident above 7 pounds per ton of iron treated. Indeed, it was found that hot metal could be desulfurized from levels as high as 0.153% sulfur and to levels as low as 0.001% sulfur with the present reagent.

Other benefits incurred by using the present invention reagent are the ease and efficiency of the subsequent slag raking operation and improved steelmaking turndown sulfur results.

The resultant spent reagent slag, while larger in volume due to the quantities of reagent injected was of a lower density such that it tended to float higher on the surface of the molten metal iron bath. Table 3 shows the quantity of slag skimmed off as a percentage of the hot metal weight at various final sulfur levels as compared to a typical lime and magnesium based reagent used at this facility. In the case of low sulfur hot metal treated with a lime and magnesium reagent the amount skimmed off was less with the present invention. At higher sulfurs there was really no difference when compared to a typical lime/magnesium reagent. The evidence is seen in the "Average % Skimmed" shown in Table 3.

The lower amounts of spent slag raked off can be attributed to two reasons. First, with the magnesium based reagents as magnesium vapor breaks the surface of the molten iron bath, droplets of iron are projected out of the bath and settle onto the spent slag layer on the surface of the bath. As more reagent is injected to achieve the lower sulfur requirements, especially less than 0.005% sulfur, more slag is generated and more iron becomes entrapped. With this reagent even though large volumes of slag are generated, iron does not become entrapped because the reaction turbulence is very limited. Second, lower amounts of slag-metal are skimmed off because the lower density/high volume, floating nature of the slag allowed the operator to rake the slag more efficiently with fewer strokes.

Sampling of the slag at the desulfurization station has never been representative and so the iron content of the slag was not determined. However, there is anecdotal evidence that the slag contained less iron because of the friability of the bulk slag when dumped after cooling at the reclamation yard.

Table 3 also compares the sulfur pickup during the oxygen steelmaking process after using this reagent and after the normal lime and magnesium reagent. With all other factors remaining the same (scrap sulfur content, steelmaking flux sulfur content and steelmaking practice) the lower sulfur pickup can be attributed to the characteristics of the slag that permits a more efficient slag removal.

Both these additional benefits obtained with the use of the present invention reagent represent significant cost benefits for the steelmaking facility in yield and steelmaking performance.

EXAMPLE 3

A series of 6 investigations were conducted at the same transfer ladle hot metal desulfurization facility described above. The blended reagent composition was as follows:

81% Lime

12% Aluminum Dross (40–55% Al, 25–30% $Al_2O_3$, balance impurities

5% Magnesium

2% Hydrocarbons (gilsonite containing 82% hydrocarbons)

Figure 2:
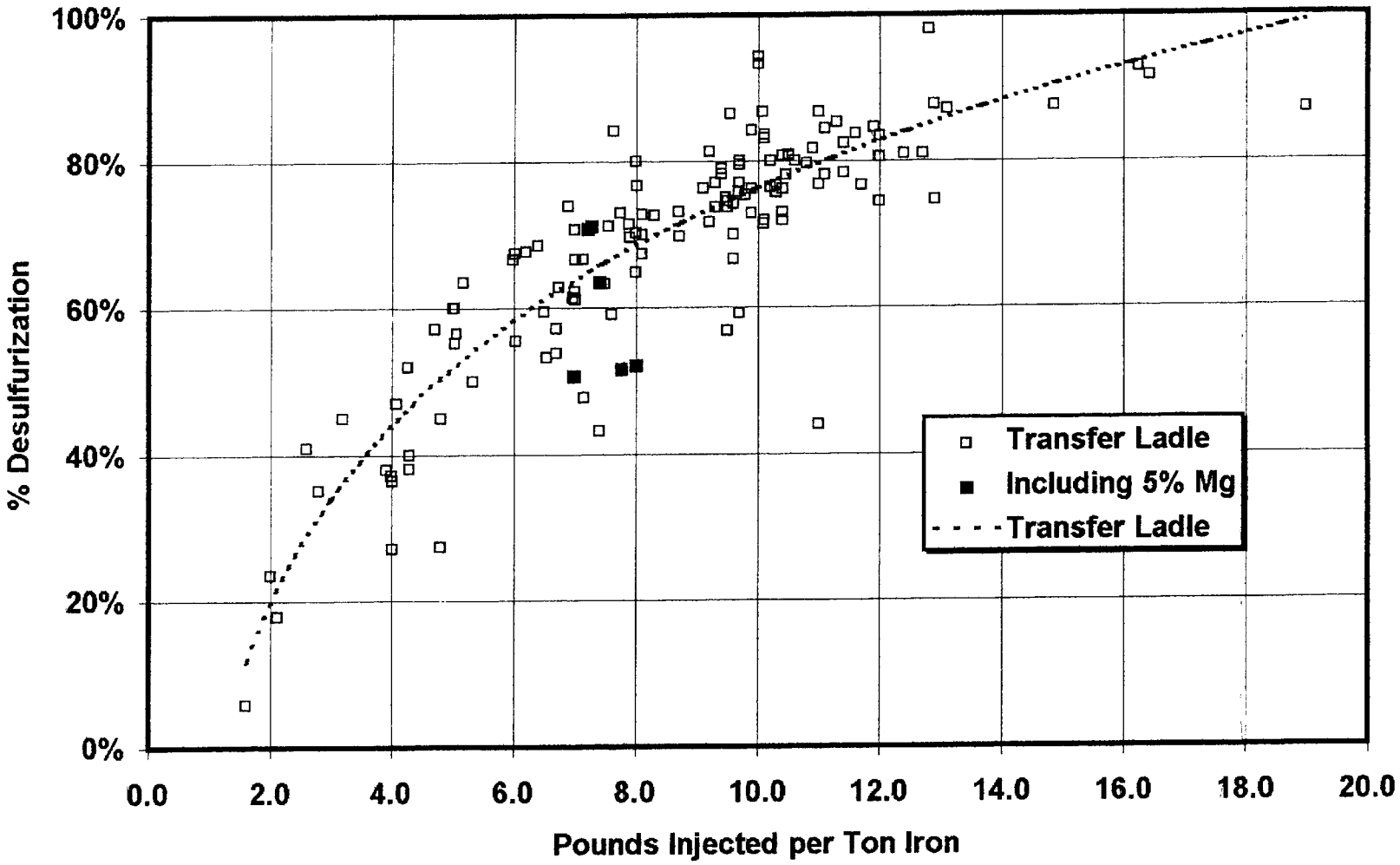
FIG. 2 is a graphical presentation showing the effect of adding magnesium to the present invention reagent in relationship to the population of data points obtained without magnesium.

Table 4 shows the degree of desulfurization obtained with the reagent and FIG. 2 portrays the degree of desulfurization in relationship to the present invention reagent. It can be seen that the addition of magnesium does not aid in increasing the degree of desulfurization with this reagent, the points being part of the same population as data obtained with the reagent described in Example 3. As described earlier, magnesium is consumed by oxygen liberated from the CaO+S reaction, and the addition of magnesium to this reagent could be considered an expensive waste.

As an alternative to including a gas generating material in the desulfurizing compositions we may inject a non-oxidizing gas into the hot metal with the desulfurizer. This gas must be injected in a manner to provide sufficient agitation in the molten metal to obtain the desired degree of desulfurization. The desulfurizing composition used in this method would contain 10% to 60% aluminum dross and the balance lime or 5% to 30% aluminum, 5% to 30% alumina and the balance lime.

While we have described certain present preferred embodiments of our desulfurization composition and method, it should be distinctly understood that our invention is not limited thereto but may be variously practiced within the scope of the following claims.

We claim:

1. A ladle desulfurization composition for desulfurizing molten pig iron, cast iron and malleable iron consisting essentially by weight of:

about 3% to about 20% particulate metallic aluminum;

about 5% to about 30% particulate alumina;

about 0.5% to about 12% particulate hydrocarbon material; and balance lime plus impurities.

2. A ladle desulfurization composition for desulfurizing molten pig iron, cast iron and malleable iron consisting essentially by weight of:

about 3% to about 20% particulate metallic aluminum;

about 5% to about 30% particulate alumina;

at least one gas generating material which generates about 0.5% to about 5.0% gas by weight which when injected into the molten iron will generate at least one gas and thereby provide agitation of the molten iron without adding oxygen to the molten iron; and balance lime plus impurities.

3. The ladle desulfurizing compound of claim 2 wherein at least some of the metallic aluminum and at least some of the alumina are aluminum dross.

4. The ladle desulfurizing composition of claim 3 wherein the aluminum dross contains a gas generating material.

5. The ladle desulfurizing composition of claim 2 wherein the gas generating material is a particulate material selected from the group consisting of soda ash, gilsonite, low sulfur, high volatile coal, polyethylene, polypropylene and rubber compounds.

6. The ladle desulfurizing composition of claim 2 wherein at least some of the metallic aluminum, alumina, gas generating material, and lime are agglomerated.

7. The ladle desulfurizing composition of claim 2 wherein at least some of alumina, is a calcium aluminate.

* * * * *